US007559158B2

(12) United States Patent
Rosendahl

(10) Patent No.: US 7,559,158 B2
(45) Date of Patent: Jul. 14, 2009

(54) ENHANCED CONSTRUCTION OF INFLATABLE INSERTS FOR ARTICLES OF FOOTWEAR

(75) Inventor: Brent Leo Rosendahl, Tualatin, OR (US)

(73) Assignee: Techsolutions Inc., Bellevue, WA (US)

( * ) Notice: Subject to any disclaimer, the term of this patent is extended or adjusted under 35 U.S.C. 154(b) by 355 days.

(21) Appl. No.: 11/415,780

(22) Filed: May 2, 2006

(65) Prior Publication Data

US 2007/0101613 A1 May 10, 2007

Related U.S. Application Data

(60) Provisional application No. 60/736,043, filed on Nov. 10, 2005.

(51) Int. Cl.
*A43B 13/20* (2006.01)

(52) U.S. Cl. ..... 36/29; 36/30 R

(58) Field of Classification Search ..... 36/29, 36/153, 154, 30 R, 28, 35 B; 12/145
See application file for complete search history.

(56) References Cited

U.S. PATENT DOCUMENTS 3,160,963 A * 12/1964 Aaskov ..... 36/11.5
5,979,086 A * 11/1999 Vindriis ..... 36/153
5,996,254 A * 12/1999 Goven ..... 36/43

* cited by examiner

*Primary Examiner*—Ted Kavanaugh
(74) *Attorney, Agent, or Firm*—Ashok Tankha

(57) ABSTRACT

An improved method of providing direct contact of inflated inserts to user's feet, comprising the steps of modifying present manufacturing procedures and components of shoe construction. The shoe last is modified to accept inflated inserts that would not normally be allowed. The modified shoe last can be returned to its original shape by inserting the matching plugs and return to its normal function. The characteristics of the function of the inflated inserts can be designed to provide support and cushioning per sport or activity specific requirements. By modifying the lasting board, out sole and sock liner, (stiffer, stronger, more flexible materials) to maximize the design intent of the inflatable inserts.

5 Claims, 3 Drawing Sheets

ENHANCED CONSTRUCTION OF INFLATABLE INSERTS FOR ARTICLES OF FOOTWEAR

CROSS-REFERENCE TO RELATED APPLICATIONS

This application claims the benefit of provisional patent application Ser. No. 60/736,043 filed 2005 Nov. 10 by the present inventor.

FEDERALLY SPONSERED RESEARCH

Not Applicable

SEQUENCE LISTING OR PROGRAM

Not Applicable

BACKROUND OF THE INVENTION

1. Field of Invention

The present invention relates to footwear and more particularly to an improved inflated insert(s) mid-sole or other types of shock absorption that directly cushions and supports the foot of the user.

2. Prior Art

Present day inflatable "Air Soles" provide the user value added support and comfort but fall short of fully utilizing the design intent of the "Air Sole Technology". The support, comfort and cushioning of the inflatable insert(s) are buried within the mid-sole and underneath the lasting board of the footwear. The full comfort and support of the inflated inserts are some what negated and the benefits are not fully enjoyed by the user. So the benefits of the "Air Sole Technology" actually work against the basic procedure for the manufacturing of footwear, by not allowing direct contact to the user's foot from the cushioning elements provided by the "Air Sole". Footwear manufactures have long sought techniques of effectively providing wearers both maximum support and comfort in their footwear.

Numerous articles of footwear have been designed in the past in an attempt to provide comfortable support for the human foot. Many of the proposed prior art inflated inserts have been designed to provide comfort and support, for example U.S. Pat. No. 4,183,156 Rudy clearly defines the present day "Air Sole" technology and U.S. Pat. No. 3,872,511 Nichols fluid chambers or cushions to absorb forces on impact. However, none of the prior art inflated inserts have provided unobstructed direct support and comfort to the wearers foot or part of body needed most. But nevertheless all the support, comfort and cushioning inflatable inserts suffer from a number of disadvantages:

a) Manufacturing techniques presently do not allow for air mid sole to protrude through lasting board and sock liner. The support, comfort and cushioning benefits are hindered by being covered by solid lasting board, hard cements and sock liner.
b) Present design and manufacturing does not allow for integration of all involved components, to function together to achieve maximum support, comfort and cushioning.
c) Last used in the construction of shoes are expensive and do not allow for inflatable inserts to be integrated during the manufacturing process.

3.Objects and Advantages

Accordingly, besides the objects and advantages of the Enhanced Construction of Inflatable Inserts for Articles of Footwear described in my patent, several objects and advantages are:

a) To provide an Inflatable Insert(s) that can be easily positioned during the manufacturing procedure which allows the Inflatable Insert(s) to protrude through the modified lasting board and modified sock liner, directly touching the user foot.
b) To provide a simple, affordable process that allows for Inflatable Insert(s) to be used without changing present day manufacturing procedures.
c) To provide a simple, affordable process that allows for Inflatable Insert(s) to be used with existing last.
d) To provide a simple, affordable process that allows for Inflatable Insert(s) to be used with existing modified lasting boards.
e) To provide an Inflatable Insert(s) that while allowing the air mid sole to protrude through all the components the sock liner becomes and integral functioning part of the shoe.
f) To provide an Inflatable Insert(s) that would allow for different materials or air pressures to conform to users requirements, weight and activity level.

SUMMARY

In accordance with the present invention an inflatable insert comprises direct contact with user's foot, a modified shoe last and modified lasting board and modified sock liner that allows inflated insert(s) mid-sole to remain uncompressed during manufacturing procedures.

BRIEF DISCRIPTION OF THE DRAWING FIGURES

DRAWINGS

Reference Numerals

Figure 1:
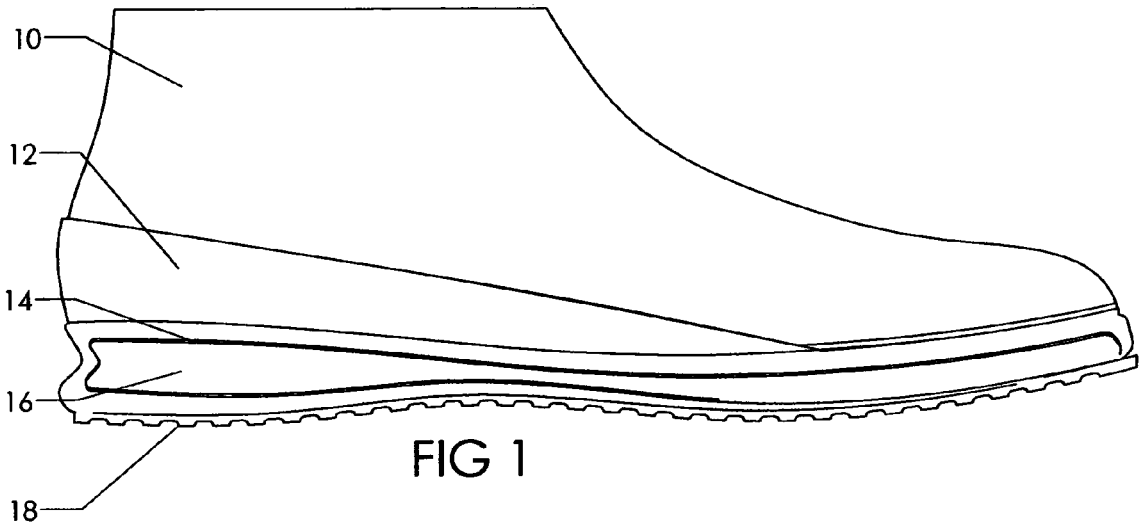
FIG. 1 is a side view of the components used during manufacturing according to a preferred embodiment of the present invention.

10 modified manufacturing shoe last with matching cut outs to accept inflatable inserts

10*a* front plug matches cut out, returns last to original shape

10*b* rear plug matches cut out, returns last to original shape

12 modified sock liner with matching cut outs.

14 modified lasting board with matching cut outs.

16 modified mid sole with protruding shock absorbing pads.

18 modified out sole with matching cut out(s).

DETAILED DESCRIPTION

FIG. 1 to 5 Preferred Embodiment

Referring now to the drawing figures, in which like reference numbers refer to like parts throughout the several views, preferred forms of the present invention will now be described by way of example embodiments. It is understood that the that the embodiments described and depicted herein are only selected examples of the many and various forms that the present invention may take, and these examples are not intended to be exhaustive or limiting of the claimed invention.

As shown in FIG. 1 a right side view showing components involved in accordance with this invention. Enhanced construction of inflatable inserts for articles of footwear designated by reference number 10 the standard manufacturing shoe last modified to accept air inserts or other types of shock absorption. The integrated modified sock liner 12 has corresponding cut outs to accept air inserts or other types of shock absorption. The modified lasting board 14 has corresponding cut outs to accept air inserts or other types of shock absorption. The mid-sole 16 contains protruding shock absorbing pads. The out sole 18 has corresponding cut outs to accept air inserts or other types of shock absorption. (The shoe upper is not shown)

Figure 2:
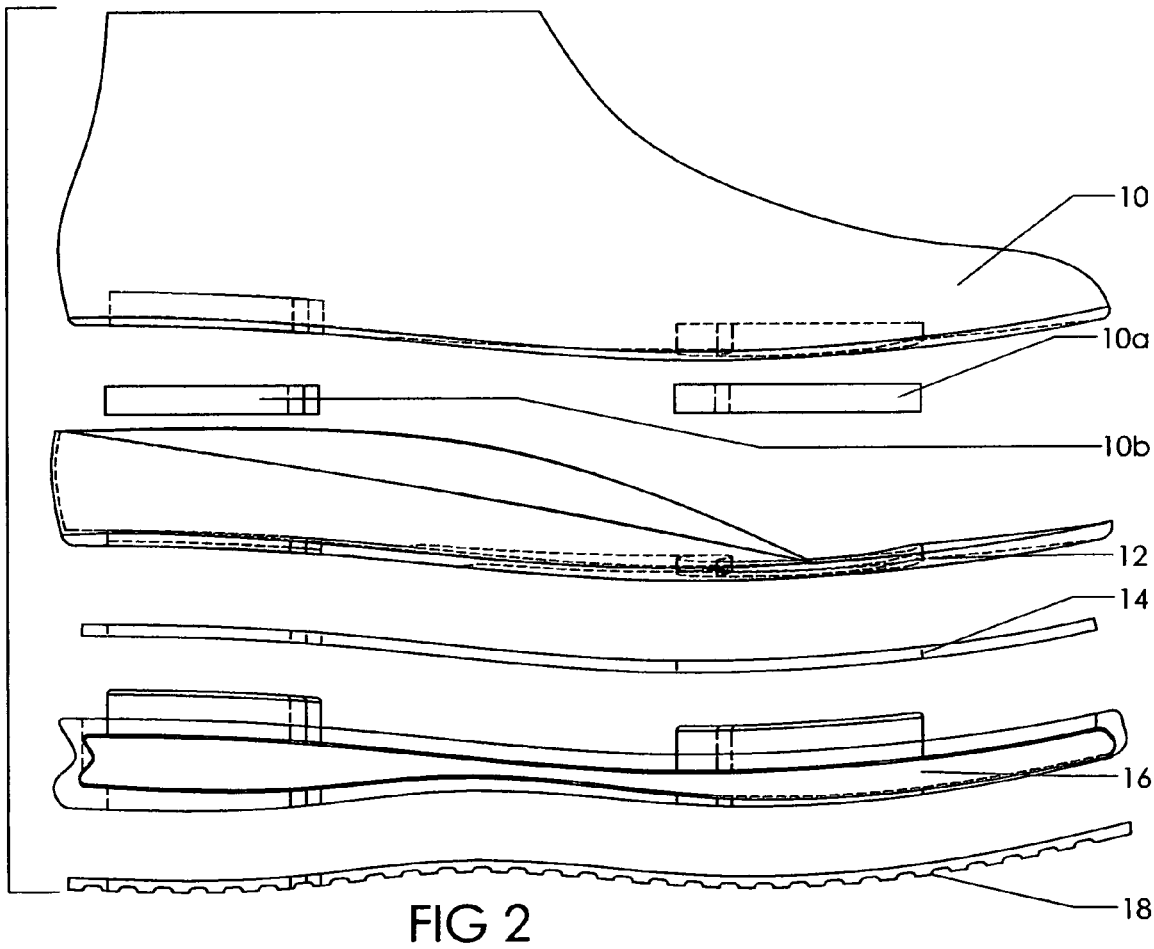
FIG. 2 is a side exploded view of the components used during manufacturing according to a preferred embodiment of the present invention.

FIG. 2 is a right side exploded view showing the relationship of the various components of this enhanced construction of inflatable inserts for articles of footwear. Standard manufacturing shoe last is modified 10 to accept air inserts or other types of shock absorption. Front plug 10*a* returns last to original shape when not in use. Rear plug 10*b* returns last to original shape when not in use. Mid-sole 16 contain air inserts or other types of shock absorption is inclusive of the integrated modified sock liner 12, the modified lasting board 14 and out sole 18, they are all formed together into one component.

Figure 3:
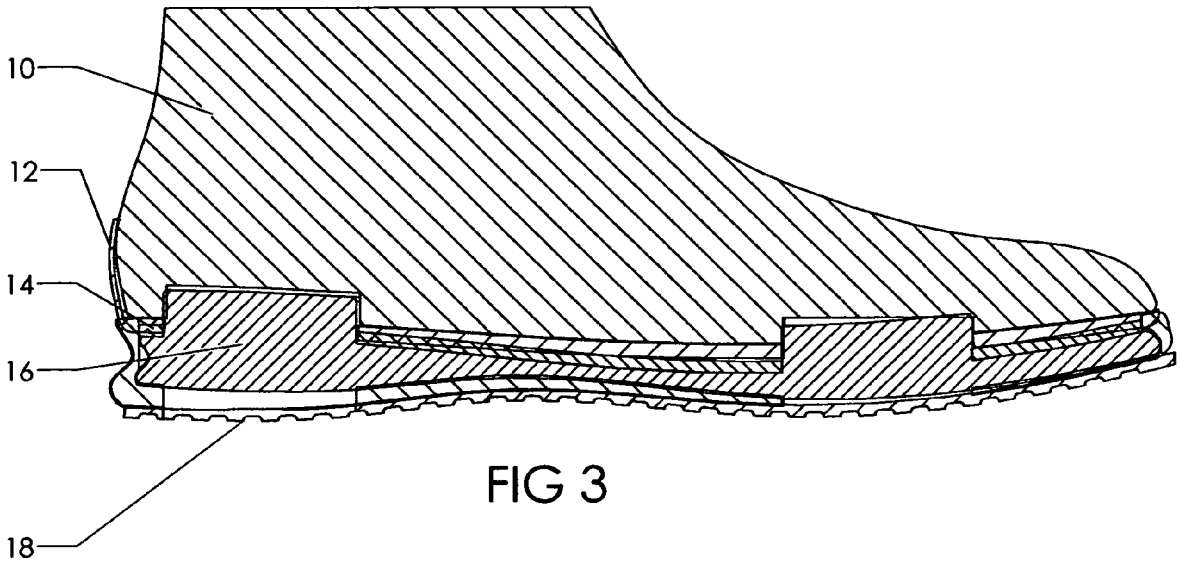
FIG. 3 is a cross section view of the components used during manufacturing according to a preferred embodiment of the present invention.

FIG. 3 represents a right side cross section view. The modified manufacturing shoe last 10 as can be seen allows for modified sock liner 12, the modified lasting board 14, mid-sole 16 with inflatable air inserts and out sole 18, they are all formed together into one component during normal manufacturing procedures.

Figure 4:
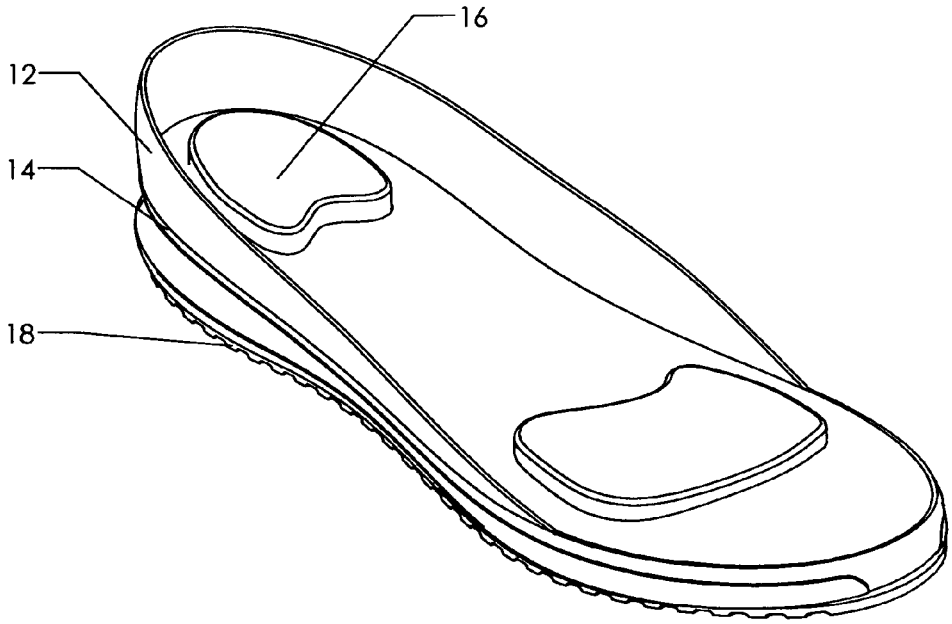
FIG. 4 is a perspective side view of the finished components according to a preferred embodiment of the present invention.

FIG. 4 is right side perspective view identifying the culmination of the manufacturing procedure. The modified sock liner 12, the modified lasting board 14, mid-sole 16 with inflatable air inserts, (shown allowing contact with user foot) and out sole 18 are combined to form one integral component. (the shoe last and upper is not shown for clarity).

Operation of the Invention

FIGS. 1-2 are a side view taken from the user's right side as constructed with in accordance with this invention. A standard last 10, has been modified for shoe production which allows for inflated inserts(s) mid-sole 16 to remain uncompressed during the lasting procedure. During production a modified lasting board 14 with pre-cut shapes allows for the inflated inserts(s) mid-sole 16 to enter unobstructed into the shoes interior. During post production the modified sock liner 12 is placed within the shoe which allows the inflated inserts(s) mid-sole 16 through the pre-cut shapes of modified sock liner 12 to combine the two elements to provide added fit, cushioning and support directly to user's foot.

Windows in the inflated inserts(s) mid-sole 16, heel or sidewalls area allow for visual and tactile sensations. The out sole 18, also with windows in the heel or forefoot area allow for visual and tactile sensations.

FIG. 3, shows modified shoe last 10 with cavities and modified lasting board 14 with matching cut outs, inflated inserts(s) mid-sole 16 and out sole 18 placements during manufacturing procedure. During shoe production the inflated inserts(s), mid-sole 16 to remain uncompressed during the lasting procedure. The inflated inserts are not concealed by the modified lasting board and modified sock liner hindering the intended function of the inflated inserts. Properly placed within the modified shoe last 10, as the shoe is being completed the inflated inserts 16 are securely anchored between the modified lasting board 14 and the out sole 18.

As shown in FIG. 4 the inflated inserts 16 protrude up through lasting board 14 and modified sock liner 12 (upper not shown). They have been anatomically placed to allow for maximum support and cushioning.

Figure 5:
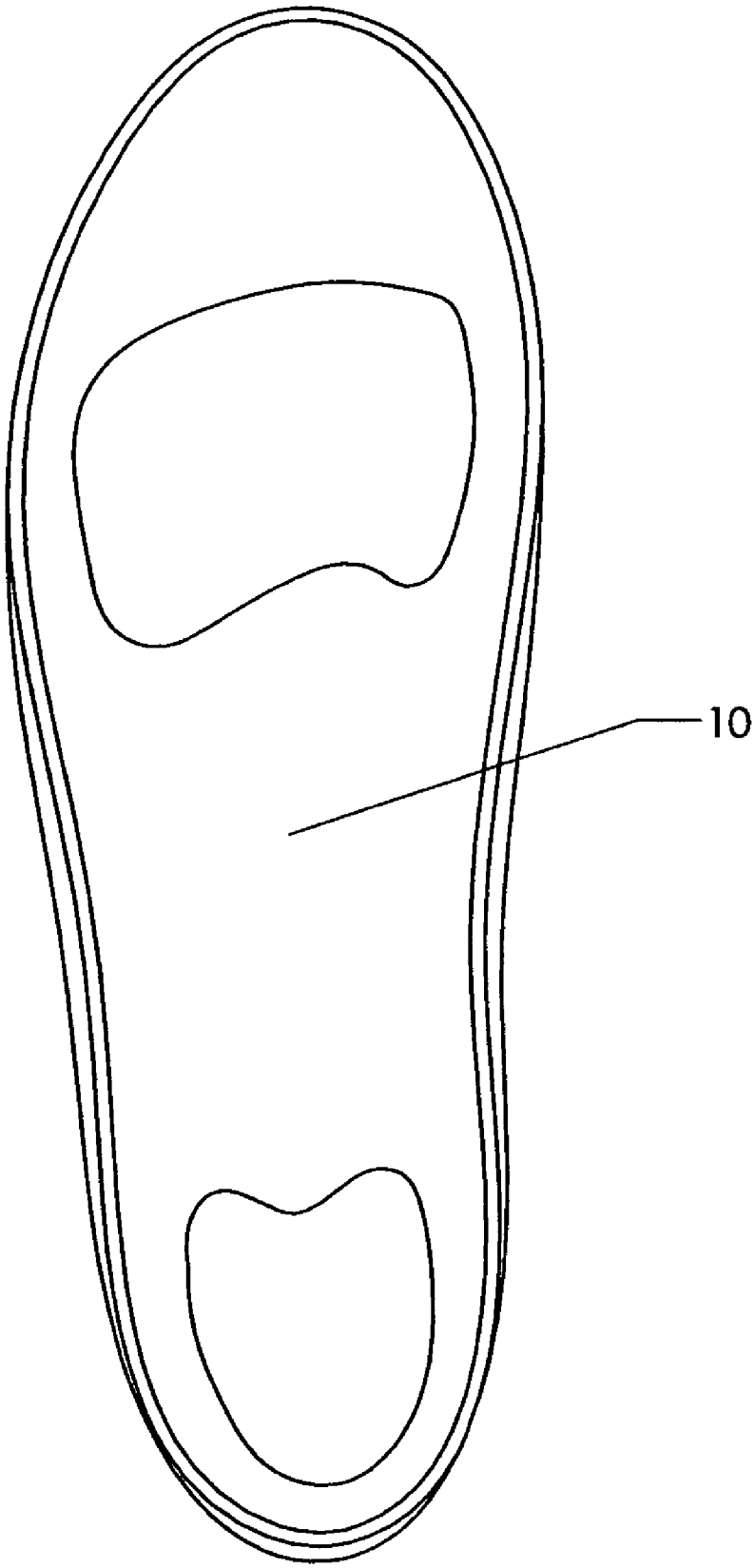
FIG. 5 is a bottom view of the modified last with cavities used during manufacturing according to a preferred embodiment of the present invention.

FIG. 5 is a bottom view of 10 modified shoe last showing front and rear cavities.

Conclusions, Ramifications and Scope

Accordingly, the reader will see that the Enhanced Construction of Inflatable Inserts for Articles of Footwear invention has many advantages over prior art.

Function: By modifying the shoe last, lasting board and sock liner with corresponding cut outs, the inflated inserts have direct contact with user's foot. Note; that the inflated inserts for cushioning and support are in direct contact with the user's foot by eliminating the material layers as used by prior art, between the foot and the inflated inserts.

Convenience: The shoe designer/manufacture and marketers can incorporate the mid-sole, inflated inserts into detailed areas of importance related to specific sport or activity. By simply allowing more or less of the inflated insert to make direct contact with the user foot will provide unobstructed support and comfort in designated areas. The corresponding components, including but not limited to the lasting board, out sole and sock liner can then be modified to match the inflated inserts requirements.

Economy: Another unique feature about this invention is that it allows for mass production of shoes with out key changes to normal manufacturing procedures, including the modification and use of existing last tooling. No other shoe manufacturers are using this technology.

Although the descriptions above contain many specifications, these should not be construed as limiting the scope of the invention but as merely providing illustrations of some of the presently preferred embodiments of the invention. For example, the inflated inserts could be one or many different shapes and height or a combination, the shock absorbing feature could be provided by different mediums such as air, gel or foam or a combination, the inflated inserts could be part of the mid-sole or separate part or a combination.

Thus the scope of this invention should be determined by the appended claims and their legal equivalents, rather than by the examples give.

What is claimed is:

1. A footwear sole for providing unobstructed support and cushioning to a foot of a user, said footwear sole comprising:

a lasting board comprising a first set of cut outs;

a sock liner comprising a second set of cut outs, corresponding to said first set of cut outs in said lasting board;

an inflated mid-sole comprising:

a first side comprising a plurality of inflated protrusions, corresponding to said second set of cut outs, wherein said inflated protrusions protrude through said second set of cut outs and said first set of cut outs for providing shock absorption and cushioning to said foot of said user; and a second side having a plurality of first set of windows;

an out sole comprising a plurality of second set of windows, wherein said second set of windows correspond to said first set of windows for further providing said shock absorption and said cushioning to said foot of said user, and wherein the out sole anchors the inflated mid-sole to said lasting board;

said inflated mid-sole, said lasting board, said sock liner, and said out sole are anatomically positioned for obtaining said foot wear sole, wherein said inflated protrusions in the foot wear sole provide direct contact to said foot of said user, thereby providing unobstructed support and cushioning to the user.

2. The footwear sole of claim 1, wherein the inflated mid-sole and the inflated protrusions comprise one of: air, gel, foam and a combination thereof.

3. The footwear sole of claim 1, wherein the mid-sole region comprises a mid-sole region and a heel region, and wherein the first set of windows are located at the mid-sole region and the heel region for providing visual and tactile sensations.

4. The footwear sole of claim 1, wherein mid-sole region comprises a sidewall region, and wherein a third set of windows are located at sidewall region for providing visual and tactile sensations.

5. The footwear sole of claim 1, wherein extent of inflation is customized based on the requirements of the user.

* * * * *